United States Patent [19]

de Queiroz Pinto et al.

[11] Patent Number: 5,045,279

[45] Date of Patent: Sep. 3, 1991

[54] CORROSION-RESISTANT CARBON STEEL WITH GOOD DRAWABILITY CHARACTERISTICS

[76] Inventors: Jose A. de Queiroz Pinto, Rua Libia, 466; Jose G. de Souza, Rua Antares, 260; Takuzo Arai, Rua Netuno, 104, all of Ipatinga - MG, Brazil

[21] Appl. No.: 359,583

[22] Filed: Jun. 1, 1989

[51] Int. Cl.[5] ..... C22C 38/16; C22C 38/60

[52] U.S. Cl. ..... 420/89; 420/90; 420/91; 420/92; 420/93

[58] Field of Search ..... 420/84, 89–93

[56] References Cited

FOREIGN PATENT DOCUMENTS

| | | | |
|---|---|---|---|
| 48-3420 | 5/1973 | Japan | 420/92 |
| 56-00224 | 1/1981 | Japan | 148/12 C |
| 56-139655 | 10/1981 | Japan | 420/92 |
| 60-162756 | 8/1985 | Japan | 420/90 |

*Primary Examiner*—Deborah Yee

[57] ABSTRACT

A corrosion-resistant carbon sheet steel with good stamping characteristics is disclosed as relating to compositions for steel resistant to atmospheric corrosion, obtained from a basis composition containing elements such as C, Mn, P, S, Al, Si, and Cu, to which are added in various ways the elements Sb, V, Cr, and Ni which make possible obtaining properties such as high resistance to corrosion associated with the stamping characteristics.

4 Claims, No Drawings

CORROSION-RESISTANT CARBON STEEL WITH GOOD DRAWABILITY CHARACTERISTICS

One of the main objectives of the processes of painting metal pieces is to increase their service life; the first phase of the processes consists in preparation of the surface (degreasing, optionally acid attack, phosphatizing, optionally chromating) and, in a second phase, application of the paint. But it happens that the metal pieces, thus phosphatized and painted, on being exposed to weathering suffer oxidizing action from the environment, becoming useless after a determined period due to corrosion problems.

It should be emphasized that all paints allows the penetration of $O_2$ and moisture from the air in greater or lesser proportions, the intensity of oxide formation being dependent on the ease of penetration of these components, as well as the resistance of the steel to corrosion. A typical example of the above-mentioned phenomenon is the case of the metal pieces that make up automobile bodies, whose service life is not considered satisfactory in any country, even though efforts have not been lacking to improve their resistance relative to corrosive appearances. The impact of stones and scratches that an automobile body occasionally receives during travel remove the protective layer of paint, facilitating the penetration of $O_2$ and moisture. With the lack of surface protection of the steel by the paint, the resistance of the steel to corrosion is very important to lengthen the service life of the painted piece.

The growing demands by the automobile industry in regard to the surface quality of sheet steel as well as the quality of paint have shown the real need to make more durable products, even though the producers of carbon sheet steel, which even today is still the main component of an automobile body, have tried to supply sheet steel with better surface qualities.

However, standard tests that have been made to evaluate corrosion do not reflect in a precise manner the resistance to oxidation of phosphatized and painted sheet steel, except in the case of low-alloy steels resistant to atmospheric corrosion. The term "low-alloy" means that said steel contains alloying elements in relatively low ranges, the main elements being Cu, Cr, P, Ni and others present in the steel called "resistant to atmospheric corrosion." Such elements give a high resistance to the corrosive action on said steel, whether it is bare or painted.

"COR-TEN" steel of U.S. Steel, containing Cu, Cr, Ni and P, is an typical example of the above case.

The generally recognized ranges of these elements are shown below:

1. Elements highly effective in providing resistance to atmospheric corrosion: Cu (0.20 to 0.50%); Cr (0.30 to 1.20%); P (<0.15%);

2. Elements reasonably effective in providing resistance to atmospheric corrosion: Ni (<0.80%); Mo (<0.35%); V (0.2 to 0.10%); Ti (0.06%);

3. Elements that practically do not contribute to resistance to atmospheric corrosion in the ranges normally encountered in carbon steel: C, Si, Mn, S.

The beneficial effect of copper on the resistance to atmospheric corrosion of steel has been a widely known fact for a long time. Standards ASTM A-109 and ABNT P-EB-295 specify steel with copper, limiting the lower content of this steel to 0.20% with a tolerance of 0.02%. This type of steel, containing copper (>0.20%), responds to the user's need only in certain applications, where specifically a greater resistance to atmospheric corrosion is required than that of common steel and not high mechanical strength.

On the other hand, the prior art does not know the effect of copper on the resistance to atmospheric corrosion of phosphatized and painted steel in the range lower than 0.15%. Test on the resistance to atmospheric corrosion of fine cold-rolled sheet, phosphatized and painted, more precisely in the case of automobile bodies, show that the presence of copper even in the range lower than 0.15%, provides a good resistance to atmospheric corrosion to the phosphatized and painted sheet steel. A patent was sought from the INPI under No. PI 8000898 for the development achieved, relating to the composition for carbon sheet steel with good stamping characteristics, resistant to atmospheric corrosion, in which an addition of copper was made, either in the form of scrap copper and/or metallic copper and/or copper coming from scrap iron rich in copper, in basic oxygen processes such as LD, OBM, LWS. The addition should be made so that the total copper content in the steel is in the range of 0.04% to 0.15%, with a tolerance of +0.02% for the maximum limit. The steel sheet can be rolled and annealed by the standard process or by the continuous process and the addition of Cu can be made in the converter, in the pot or in the ingot mold.

The steel produced by the Siemens-Martin process contains copper normally in high concentration, around 0.06 to 0.08% due to the use of scrap iron in greater proportion. However, the basic oxygen processes do not make it possible to use scrap iron in a proportion above 35% even with the adoption of the preheating system because of the problem of heat balance. This proportion, above 35% out of the total charge, would increase the copper content 0.04 to 0.05% at most.

A study made on the outlook for scrap iron by the Batelle Research Institute shows in Table I below the levels of residual elements in carbon steels (The outlook for scrap, R.D. Burlingame, Scrap Age, Feb. 1979, pp. 162 to 176).

TABLE I

Levels of Residual Elements in Carbon Steels

| | SIEMENS-MARTIN FURNACE INTEGRATED MILL 50% SCRAP 50% LIQUID PIG | ELECTRIC FURNACE UNINTEGRATED MILL 100% SCRAP |
|---|---|---|
| Cu % | 0.063 | 0.151 |
| Ni % | 0.031 | 0.085 |
| Cr % | 0.029 | 0.071 |
| Mo % | 0.007 | 0.011 |
| Sn % | 0.007 | 0.017 |

On the basis of the above table, the proportion of 35% of scrap iron out of the total amount of charge would increase the copper content about 0.04 to 0.05% at most, when outside scrap, i.e., bought scrap, normally very rich in alloy elements, is used.

Since an integrated mill is obliged to use inside scrap, whose production corresponds more or less to 18% of crude steel produced by it in case of standard ingot casting, or 10% in case of continuous ingot casting, carbon steel will never be produced with a copper content above 0.04%. Actually, various samples from integrated mills of some countries exhibit a copper content as shown in Table II.

TABLE II

| Sheet steel samples | |
|---|---|
| STEEL SAMPLE IN THE FORM OF FINE COLD-ROLLED SHEET OBTAINED BY THE LD PROCESS | CU % |
| Killed steel - Japanese sample | 0.011 |
| German steel (1) | 0.022 |
| (2) | 0.025 |
| Brazilian steel | 0.007 to 0.035 |

| ELEMENT | % |
|---|---|
| C | 0.005~0.15 |
| Mn | 0.10~0.60 |
| P | <0.03 |
| S | <0.03 |
| Al | 0.00~0.090 |
| Cu | 0.04~0.15 |
| Si | <1.0 |
| Residual elements | In the ranges usually encountered |

However, later studies shown that the copresence of some elements such as antimony, vanadium and chromium, in low contents, provide a resistance to atmospheric corrosion greater than that obtained with the addition of only copper in the claimed range, mainly an industrial and marine atmosphere being involved. Additional elements were combined with the elements claimed in PI 8000898, in the way disclosed in Table IV, constituting the object of this invention.

The upper limit of aluminum was set at 0.090% above which problems in production of sheet steel with adequate surface quality arise. The lower limit of aluminum was set at 0.02%.

Silicon can be used as deoxidizing agent in refining steel; its upper limit was set at 1.0%; a value above which the steel becomes fragile or exhibits excessively high mechanical strength.

The reasons for the limitation of the copper content in the range of 0.04 to 0.15%, in this invention, are the following:

The lower limit of 0.04% was established to have a good resistance to atmospheric corrosion of the phosphatized and painted sheet steel, while other conditions would favor resistance to atmospheric corrosion, which are the presence of some residual elements and the absence of others, such as sulfur and phosphorus, the operational parameters having to be considered. As mentioned above, the presence of sulfur detracts from the resistance to corrosion of the steel, contrary to what happens with the presence of phosphorus. The upper limit of 0.15% was established taking into account its negative effect on mechanical properties, particularly stampability, raising of production cost and the saturation of the beneficial effect relative to resistance to atmospheric corrosion of the phosphatized and painted sheet steel (bibliography: "Sheet Metal Industries" Jan. 1967, pp. 21-30), (FIG. 2 and 3).

The beneficial effect of copper on resistance to corrosion of the fine cold-rolled, phosphatized and painted sheet reaches its saturation above the upper limit established in this invention, even if other conditions do not favor said resistance, which are the presence of carbon in high concentration, high content of sulfur and others. The beneficial effect was detected in a remarkable way only by corrosion test in exposure to weathering.

TABLE IV

| STEELS STUDIED | Chemical composition claimed in PI 8000898 with additions of antimony, vanadium and chromium (% by weight) ELEMENTS (%) | | | | | | | | | | |
|---|---|---|---|---|---|---|---|---|---|---|---|
| | C | Mn | P | S | Al | Si | Cu | Sb | V | Cr | Ni |
| 1 | 0,01 a 0,15 | 0,10 a 0,60 | ≦0,03 | ≦0,03 | ≦0,090 | ≦1,0 | 0,04 a 0,15 | 0,02 a 0,20 | — | — | ≦0,010 |
| 2 | 0,01 a 0.15 | 0,10 a 0,60 | " | " | " | " | 0,04 a 0,15 | 0,02 a 0.20 | 0.01 a 0.10 | — | " |
| 3 | 0,01 a 0.15 | 0,10 a 0,60 | " | " | " | " | 0,04 a 0,15 | 0,02 a 0,20 | — | ≦0.30 | " |
| 4 | 0.01 a 0,15 | 0,10 a 0,60 | " | " | " | " | 0,04 a 0.15 | — | 0,01 a 0,10 | — | " |
| 5 | 0,01 a 0,15 | 0.10 a 0,60 | " | " | " | " | 0,04 a 0,15 | 0,02 a 0,20 | 0,01 a 0,10 | ≦0,30 | " |
| 6 | 0,01 a 0,15 | 0,10 a 0.60 | " | " | " | " | 0,04 a 0.15 | — | 0,01 a | ≦0,30 | " |

The upper limit of the carbon was established at 0.15%, aimed at avoiding its prejudicial effect in regard to the workability of the fine cold-rolled sheet in the stamping mill. The lower limit corresponds to the minimum values that can be obtained in LD converters.

The upper limit of manganese was set at 0.6% due to the problem of cold workability, while the lower limit was set at 0.1% for the deoxidation effect in steel refining.

The presence of phosphorus in high concentration improves the resistance to atmospheric corrosion but is unfavorable from the viewpoint of weldability and ductility, a reason for which its upper limit was set at 0.03%, steel production conditions being taken into account.

Sulfur in itself is inert in regard to resistance to atmospheric corrosion of steel, but it has a negative influence on resistance to corrosion, when sulfides are formed. Therefore, the upper limit was set at 0.03%, the normal production conditions being taken into account.

As everyone knows, copper is in steel in solubilized state until it reaches 0.25% more or less at ambient temperature; from this value, the mechanical properties of steel can suffer deterioration with respect to stampability.

Although this test takes more time to obtain results, its great advantage is that the test conditions are like the natural ones to which the automobile body is exposed during use. Therefore, the results thus obtained represent the actual behavior of the phosphatized and painted sheet during use.

The accelerated corrosion test in a saline mist, generally recognized as a standard method, does not adequately simulate natural conditions. The results obtained by this method do not always show the actual behavior of the phosphatized and painted sheet steel in regard to resistance to atmospheric corrosion.

The addition of antimony alone or together with other elements such as copper, chromium, tin, niobium, etc. to improve the resistance to corrosion of steel in various surroundings has been claimed in many patents, some examples of the chemical composition of corrosion-resistant steels containing antimony as well as their applications are shown in Table V.

TABLE V

Addition of antimony to steel to increase resistance to corrosion.

| | PATENT | | |
|---|---|---|---|
| ELEMENTS | JAPANESE (1975) SHO-50-39044 | JAPANESE (1975) SHO-53-100121 | JAPANESE (1975) SHO-50-17315 |
| C | 0,01~0,15% | <0,3% | 0,25~1,0% |
| Si | 0,1~3,0% | <1,0% | 0,8~2,0% |
| Mn | 0,1~2,0% | 0,2~1,2% | 0,3~2,0% |
| P | <0,03% | <0,04% | 0,020~0,060% |
| S | <0,03% | <0,01% | 0,012~0,018% |
| Cr | 0,5~5,0% | — | 0,05~2,0% |
| Al | 0,02~0,05% | — | — |
| Cu | 0,1~0,6% | — | 0,05~0,5% |
| Sb | 0,02~0,2%* | 0,01~0,1% | Mo = 0,15% |
| Sn | 0,02~0,2%* | (one of Sb | only |
| | | Sn Bi or only | Mo 0,15% + Ni 1,0% |
| (Ti, Zr, Nb, | 0,02~0,5%* | one of these | only |
| together | | 3 elements) | Ni 1,5% |
| or alone) | | | only |
| | | | Sb 0,03 + Sn 0,02% |
| APPLI- | MARINE | PIPES | MARINE |
| CATION | STRUCTURE | | STRUCTURE |

OBS.
*Total Amount of the elements together or one of the added elements alone.

It happens that the steels shown in Table V belong to the class of hot-rolled low-alloy steels that are not suitable for applications in deep drawing.

The lower limit of antimony was set at 0.01% below which the effect of its addition to resistance to atmospheric corrosion of the phosphatized and painted sheet steel is practically nonexistent. On the other hand, its presence in relatively high contents detracts from both the weldability and hot workability, a reason for which the upper limit was set at 0.20%.

Chromium is generally added in about 0.05% to avoid diffusion of the carbon on the surface of the fine hot-rolled sheet during its annealing. Moreover, the presence of chromium can be beneficial in terms of resistance to corrosion, particularly with the copresence of copper. However, just as in the case of copper and antimony in higher contents, its presence exhibits negative effects in regard to workability and ductility of the steel, a reason for which its upper limit was set at 0.30%.

The presence of nickel together with copper and chromium in the ranges established above does not much improve the resistance to corrosion of phosphatized and painted sheet. Therefore, this element can be present or not in the compositions claimed by this invention.

Vanadium added to the steel combines with carbon and nitrogen partially or wholly, forming carbides or nitrides. These compounds restrict the growth of the grains, which contributes to reducing its susceptibility to localized corrosion. Moreover, vanadium present in the steel in solubilized form increases its resistance to corrosion. The upper limit of 0.10% was established to avoid deterioration of the material in regard to deep-drawing.

The lower limit of said element was established at 0.01%, below which its beneficial effect is not clearly verified.

EXAMPLE

The test of the corrosion of the cold-rolled sheet steel was performed as follows:

Test bodies (110 mm×290 mm) were degreased, phosphatized and painted, then they were marked with a X-shaped cut and subjected to the unaccelerated atmospheric corrosion test (exposure to natural weathering), according to standard Number 7011.

After the test, the average advance of the corrosion along the X-shaped cut (average of 20 measurements) as well as the maximum penetration of the corrosion through the thickness of the test body (average of 8 measurements) were evaluated by means of optical microscopy. It should be pointed out that the measurement of the total advance of the corrosion of the test body was initially subjected to a mechanical scrapping of the marks, and later, the paint film was totally removed with concentrated sulfuric acid.

Table VI shows the chemical composition of the tested steels by way of example and Table VII shows results of unaccelerated test of atmospheric corrosion. Table VIII was developed from Table VII by multiplying the standing frequency by the resistance reference number.

In Table VIII the overall numerical evaluation in regard to resistance to atmospheric corrosion of steels can be observed, the following ascending order occurring:

| | |
|---|---|
| Composition: (Table) | 1 + 3 + 6 + 2 + 4 + 5 |

That is, the presence of antimony or vanadium together with copper in the steel exhibits a notable improvement in the resistance to atmospheric corrosion of the painted sheet steel.

TABLE VI

| STEEL (NO.) | Chemical composition of tested sheets CHEMICAL COMPOSITION (%) × $10^{-3}$ C | Mn | S | P | Al Sol. | Si | Cu | Sb | V | Cr | Ni | Nb | OBSERVATIONS |
|---|---|---|---|---|---|---|---|---|---|---|---|---|---|
| 1 | 040 | 350 | 013 | 014 | 012 | 020 | 019 | <002 | 005 | <020 | 019 | <002 | Reference |
| 2 | 045 | 340 | 019 | 015 | 038 | 030 | 140 | <002 | 005 | <020 | 019 | <002 | Brazil Patent Application PI 8000898 |
| 3 | 031 | 390 | 017 | 012 | 030 | 020 | 056 | <002 | 005 | 050 | 040 | <002 | Reference |
| 4 | 030 | 350 | 024 | 014 | 054 | 030 | 063 | <002 | 048 | <020 | 022 | <002 | Present invention |
| 5 | 031 | 390 | 017 | 011 | 050 | 020 | 051 | 037 | 005 | <020 | 020 | <002 | Present invention |
| 6 | 031 | 340 | 021 | 012 | 018 | 030 | 064 | <002 | 008 | 050 | 017 | <002 | Reference |

TABLE VII

Corrosion test: 12 months of exposure to natural weathering (unaccelerated atmospheric corrosion test)

| STEEL NO. | ANODIC PAINTING (2) ATMOSPHERE 1 (4) A (6) | (8) | P (7) | (8) | ATMOSPHERE 2 (5) A (6) | (8) | P (7) | (8) | CATHODIC PAINTING (3) ATMOSPHERE 1 (4) A (6) | (8) | P (7) | (8) | ATMOSPHERE 2 (5) A (6) | (8) | P (7) | (8) |
|---|---|---|---|---|---|---|---|---|---|---|---|---|---|---|---|---|
| 1 | 100 | (6°) | 100 | (6°) | 100 | (5°) | 100 | (6°) | 100 | (6°) | 100 | (6°) | 100 | (5°) | 100 | (6°) |
| 2 | 54 | (2°) | 60 | (3°) | 140 | (6°) | 95 | (5°) | 55 | (2°) | 43 | (2°) | 90 | (3°) | 92 | (3°) |
| 3 | 79 | (5°) | 80 | (5°) | 86 | (4°) | 60 | (2°) | 75 | (5°) | 57 | (5°) | 105 | (6°) | 99 | (5°) |
| 4 | 63 | (4°) | 47 | (1°) | 82 | (3°) | 58 | (1°) | 58 | (3°) | 52 | (3°) | 88 | (2°) | 89 | (1°) |
| 5 | 45 | (1°) | 53 | (2°) | 62 | (1°) | 63 | (3°) | 27 | (1°) | 33 | (1°) | 76 | (1°) | 92 | (2°) |
| 6 | 56 | (3°) | 60 | (3°) | 78 | (2°) | 70 | (4°) | 71 | (4°) | 52 | (4°) | 91 | (4°) | 96 | (4°) |

Observations:
(1) Relative to steel (1):
mm (n) mm (l)
(2) Painting system:
Phosphatizing - anodic electrophoretic painting - intermediate painting - finishing painting (enamel)
(3) Painting system:
Phosphatizing - cathodic electrophoretic painting - intermediate painting - finishing painting (enamel)
(4) Industrial atmosphere
(5) Marine atmosphere
(6) Advance along the mark (index)
(7) Penetrating corrosion (index)
(8) Standing in tems of resistance:

When the percentage numbers are compared, that composition is considered better whose advance or penetration is less than the other.

TABLE VIII

| COMPOSITION STEEL NO. | STANDING FREQUENCY IN RESISTANCE FREQUENCY STANDING IN RESISTANCE 1a | 2a | 3a | 4a | 5a | 6a | NEGATIVE POINTS FREQUENCY × STANDING | EVALUATION |
|---|---|---|---|---|---|---|---|---|
| 1 | | | | | 2 | 6 | (2 × 5) + (6 × 6) = 46 | 6° |
| 2 | | 3 | 3 | | 1 | 1 | (3 × 2) + (3 × 3) + (1 × 5) + (1 × 6) = 26 | 3° |
| 3 | | 1 | | 1 | 5 | 1 | (1 × 2) + (1 × 4) + (5 × 5) + (1 × 6) = 37 | 5° |
| 4 | 3 | 1 | 3 | 1 | | | (3 × 1) + (1 × 2) + (3 × 3) + (1 × 4) = 18 | 2° |
| 5 | 5 | 2 | 1 | | | | (5 × 1) + (2 × 2) + (1 × 3) = 12 | 1° |
| 6 | | 1 | 2 | 5 | | | (1 × 2) + (2 × 3) + (5 × 4) = 28 | 4° |

From Table VIII it can be concluded that compositions 5 and 4 show better results in terms of resistance to atmospheric corrosion under various conditions, when compared with compositions containing copper and optionally chromium and nickel but without vanadium or antimony. It is also concluded that the presence of chromium partially compensates for the relatively low copper content within the range claimed in PI 8000898.

In regard to mechanical properties, the results obtained can be observed in Table IX in which steels 1 and 4 of Table IV can be characterized as steels for deep and medium drawing, respectively.

TABLE IX

Mechanical Properties for Steels 1 and 4 of Table IV

| TYPE OF STEEL | LE $N/m^2$ | LR $N/m^2$ | *Al (%) |
|---|---|---|---|
| 1 | 190 | 327 | 45 |
| 4 | 290 | 375 | 41 |

*Measurement base = 50 mm

We claim:

1. A chemical composition for a phosphatized and painted carbon sheet steel having enhanced drawability characteristics and a high resistance to atmospheric corrosion, said chemical composition, consisting of C (0.01–0.15%), Mn (0.10–0.60%), P (≦0.03%), Al (0.03–0.090%), Si (0.03–1.0%), Cu (0.04–0.15%), and Sb (0.02–0.20%), and further consisting of at least one alloy element selected from the group consisting of (0.01–0.10%), Cr (0.02–0.30%), or Ni (0.02–0.10%), wherein all percentages are by weight.

2. A chemical composition as claimed in claim 1 wherein the elements selected from the group consist of vanadium (0.01–0.10%) and nickel (0.02–0.10%).

3. A chemical composition as claimed in claim 1 wherein the elements selected from the group consist of chromium (0.02–0.30%) and nickel (0.02–0.10%).

4. A chemical composition as claimed in claim 1 wherein the elements selected from the group consist of vanadium (0.01–0.10%), chromium (0.02–0.30%), and nickel (0.02–0.10%).

* * * * *

UNITED STATES PATENT OFFICE

CERTIFICATE OF CORRECTION

Patent No. 5,045,279 Dated 09/03/91

Inventor(s) Jose A. de Queiroz Pinto and Jose G. de Souza

It is certified that error appears in the above-identified patent and that said Letters Patent is hereby corrected as shown below:

At column 8.

At column 8, line 55 (claim 1), after the last word "of" insert -- V --.

Signed and Sealed this

Twelfth Day of January, 1993

*Attest:*

DOUGLAS B. COMER

*Attesting Officer*

*Acting Commissioner of Patents and Trademarks*